US008658875B2

(12) United States Patent
Albright

(10) Patent No.: US 8,658,875 B2
(45) Date of Patent: Feb. 25, 2014

(54) DRUM TUNING AND TUNING STABILIZATION MECHANISM

(76) Inventor: Gary T. Albright, Grants Pass, OR (US)

( * ) Notice: Subject to any disclaimer, the term of this patent is extended or adjusted under 35 U.S.C. 154(b) by 0 days.

(21) Appl. No.: 13/520,549

(22) PCT Filed: Jan. 5, 2011

(86) PCT No.: PCT/US2011/020263

§ 371 (c)(1),
(2), (4) Date: Jul. 3, 2012

(87) PCT Pub. No.: WO2011/085032

PCT Pub. Date: Jul. 14, 2011

(65) Prior Publication Data

US 2013/0032021 A1 Feb. 7, 2013

Related U.S. Application Data

(60) Provisional application No. 61/292,423, filed on Jan. 5, 2010.

(51) Int. Cl.
*G10D 13/02* (2006.01)

(52) U.S. Cl.
USPC ..... 84/413; 84/411 R

(58) Field of Classification Search
USPC ..... 84/413, 411 R
See application file for complete search history.

(56) References Cited

U.S. PATENT DOCUMENTS

| | | | | |
|---|---|---|---|---|
| 3,754,486 | A | 8/1973 | Mariner | |
| 4,211,144 | A | 7/1980 | May | |
| 4,282,793 | A * | 8/1981 | Muchnick | 84/414 |
| 4,869,146 | A | 9/1989 | Bonsor | |
| 5,584,410 | A * | 12/1996 | Siblik | 220/320 |
| 6,018,116 | A * | 1/2000 | Simons et al. | 84/411 R |
| 6,031,169 | A | 2/2000 | Coppola | |
| 6,459,026 | B1 * | 10/2002 | Bozzio | 84/411 R |
| 6,891,100 | B2 * | 5/2005 | Crouch | 84/421 |
| 6,949,702 | B2 * | 9/2005 | Ortega et al. | 84/413 |
| 7,307,204 | B2 * | 12/2007 | Ito | 84/411 R |
| 7,402,740 | B2 * | 7/2008 | van der Meulen | 84/413 |
| 7,960,633 | B1 * | 6/2011 | Chen | 84/413 |
| 8,110,730 | B2 * | 2/2012 | Burdick | 84/411 R |
| 2004/0081531 | A1 * | 4/2004 | Keane | 411/119 |
| 2005/0145091 | A1 | 7/2005 | Okuno | |
| 2007/0131087 | A1 * | 6/2007 | Chen | 84/411 R |
| 2007/0163400 | A1 | 7/2007 | Parise | |
| 2009/0064844 | A1 | 3/2009 | O'Connor | |
| 2010/0269669 | A1 * | 10/2010 | O'Connor | 84/413 |
| 2013/0032021 | A1 * | 2/2013 | Albright | 84/413 |

* cited by examiner

*Primary Examiner* — Robert W Horn
(74) *Attorney, Agent, or Firm* — Craig M. Stainbrook; Stainbrook & Stainbrook, LLP

(57) ABSTRACT

A drum tuning stabilizer including a threaded lug screw shaft which can be rotated along its axis to adjust the tension on a drum head by changing the position of a drum hoop relative to the shell. At least one of a lug casing of the drum shell and a rim portion of the drum hoop has a threaded hole configured to receive the threaded lug screw shaft for rotation. A lug screw lock is threaded on the lug screw shaft adjacent the threaded hole of the lug casing and the rim portion of the drum hoop and can be rotated to tighten the lug screw lock against a surface adjacent to the threaded hole of the lug casing and the rim portion of the drum hoop to provide an interference fit to lock the threaded lug screw shaft to the surface adjacent the lug casing and the rim portion of the drum hoop having the threaded hole therein.

30 Claims, 9 Drawing Sheets

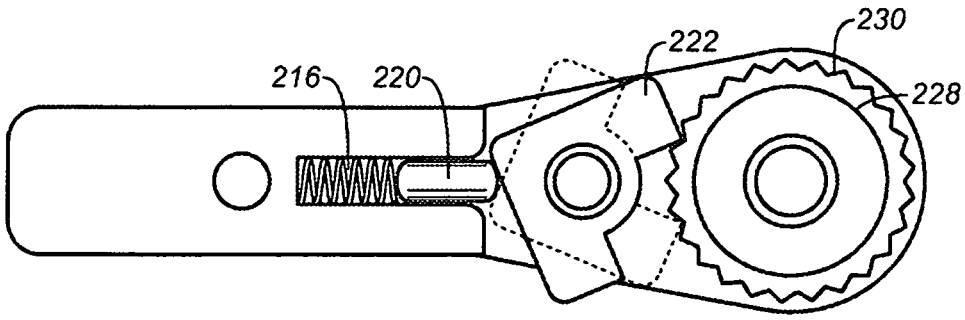
FIG. 6
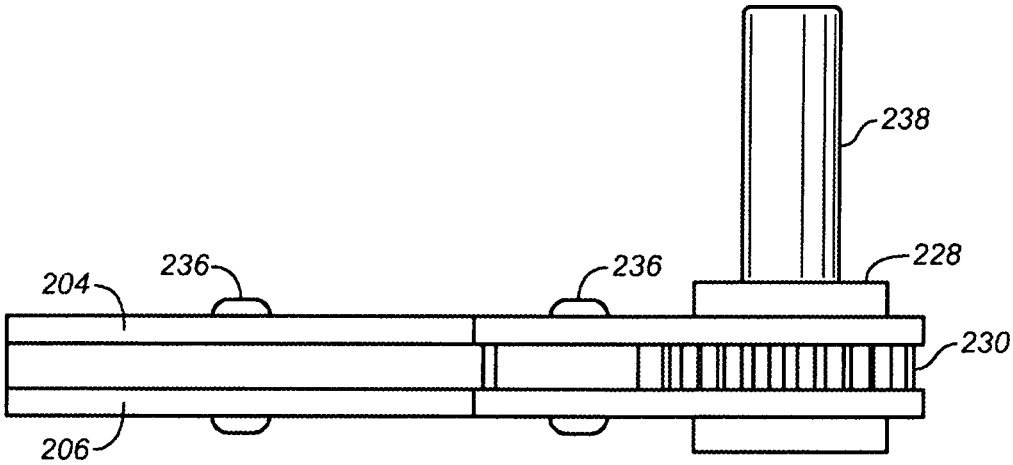
FIG. 6A
FIG. 6B
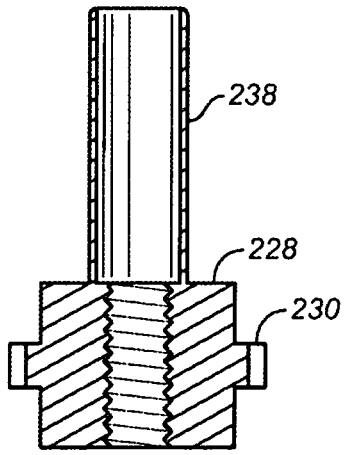

DRUM TUNING AND TUNING STABILIZATION MECHANISM

BACKGROUND OF THE INVENTION

1. Technical Field

The present invention relates generally to drum tuning systems, and more particularly to a drum tuning and tuning stabilization mechanism that uses an element to engage a drum hoop to provide a force opposing the force provided by a tensioning lug screw to pinch and secure the hoop and thereby prevent the drum head from loosening during play.

2. Background Art

Drums included in typical popular music drum kits are generally uniform structurally. The kits themselves generally include, at a minimum, a bass drum, a floor torn, bass drum mounted toms, a side snare drum, a crash symbol, and a high hat. Much more elaborate systems are common, though generally including this base set. Each of the drum elements have a standard structure, which includes a cylindrical drum shell or body covered at each of its open ends with a tightly stretched drum head.

Collectively, the body and drum heads create a resonant cavity that vibrates dramatically with each strike of a drum stick on a drum head. The drum heads are typically round and have a diameter that exceeds that of the openings on the drum body, such that the outer portion of the head can be folded over the sides of the body. The heads are held on the ends and pulled tight by drum hoops that comprise an annular channel placed over the rim of the body and having an outwardly extending flange through which a plurality of evenly spaced apart holes are disposed.

The hoop is bolted to the drum body by lug bolts inserted through the holes in the hoop. The lug bolts include an underside disposed over the outer surface of the hoop and ends that are threadably inserted into lug casings having a nut incorporated and secured therein. Tightening the lug bolt pulls the hoop channel downward onto the drum body. Thus, the lug bolts provide a way to adjust the tension on the hoop, and thereby to adjust the tension of the drum head.

As a drum head is repeatedly struck with drumsticks, either in the center of the head or near the periphery, and especially during rimshots, where the rim and the head of a drum are struck at once to produce accented notes, the hoop depresses slightly and provides a very small clearance from the underside of the proximate lug bolt heads. The allows the lug nuts to loosen in extremely small increments, such that during play, the drum will slowly go out of tune.

It is impractical and disruptive to tune a drum head repeatedly during performances. Accordingly, it would be advantageous to provide means to prevent the lug bolts from loosening and thereby to keep a drum head in tune. Mechanisms of this kind have been proposed, examples of which are set out as follows:

U.S. Pat. No. 6,747,199 to Shah, discloses a quick release lug system for drums. The mechanism enables quick removal of a drumhead and eliminates the need to unscrew multiple tuning rods. It does so by providing a cam lever that can be pulled down to lock the hoop on the drum body and tighten the drum head.

U.S. Pat. No. 5,208,412 to Hoshino teaches a mechanism for holding a drum head on a drum body by a drum hoop passing around the edge of the drum head. A lug on the side of the drum body has an axial opening which receives a lug nut. The lug nut has an axial threaded opening. A threaded bolt, which engages the drum head hoop, is tightened into the threaded opening of the lug nut and draws the drum hoop to tighten the drum head. A radial opening extends radially through the lug nut from the opening in the lug to the threaded opening for the bolt. An elastic bolt engaging and bolt rotation resisting chip in the radial opening engages the lug on the outside and the bolt in the lug nut opening for restraining rotation of the bolt. There may be a drum head at each end of the drum body, a respective lug near each drum head and a single element defining both lug nuts.

U.S. Pat. No. 4,928,566 to Yanagisawa describes a pair of tension bolts that apply tension to a pair of drum heads screwed into nuts that are held by a pair of lug bodies fixed to a drum shell. The lug bodies are connected to one another by a connecting member with opposite ends fitted individually in openings at the respective end portions of the lug bodies. A hole is formed in each end portion of the connecting member. The lug bodies and the connecting member are connected so that projections on the lug bodies are fitted individually in the holes of the connecting member.

U.S. Pat. No. 4,506,586 to Brewer discloses a quick release drum head restraint including a pendulum and a toggle that enable a user to quickly remove and replace a drum head without significantly altering the tuning of the drum head.

U.S. Pat. No. 6,242,680 to Benton, Jr., teaches a drum tuning plates that distribute the drawing force exerted on the drumhead by the tensioning lugs. The tuning plates have a circumferential dimension substantially greater than the radial dimension and the thickness dimension and have an arcuate inner surface conforming to the radial contour of the drum hoop and an outer surface substantially parallel to the inner surface. Each tuning plate has an opening that enables it to be positioned between the head portion of one of the tensioning lugs and the drum hoop.

U.S. Pat. No. 5,977,463 to Bartlett shows a drum tuning mechanism having a pair of membrane mounting and tuning assemblies, one for each end of the shell. Each tuning assembly includes a lug casings that include a worm gear for turning and tightening tuning lugs disposed through the drum head hoop.

The foregoing patents reflect the current state of the art of which the present inventor is aware. Countless other drum tuning mechanisms are known to exist, though the foregoing are exemplary and representative of contemporary systems adapted for use with currently used acoustic drums. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described herein. Specifically, none of the foregoing patents teaches an apparatus for unifying the drum component parts so as to improve energy transfer from drumstick impact to the drum resonant chamber, nor do they show any means of preventing changes in tuning that occur during play as a result of the repeated changes in pressure on the drum hoop and hoop rim that vibrate and loosen the adjustment lug screws. There remains a need for such an apparatus.

DISCLOSURE OF INVENTION

When a conventional drum without the present invention is played, the drum rim is attached to the drum shell over the drum head or skin using the standard drum rim, lug screw, and lug assembly. This drum assembly allows for a degree of the energy delivered by the drumstick impact to enter the resonant chamber. Tonal quality is a function of how well the part of the drum transmits the impact energy to the drum, and how much of that energy strike actually makes it into the resonant chamber.

The present invention improves the tonal quality of drums. Because of the way drums have always been, and currently are assembled, the component parts—drum shell, drum heads, top and bottom rim hoops, drum lugs, and lug screws—do not form a solid inflexible energy and tone transfer unit. There is nothing to prevent the top hoop rim from flexing when struck by the stick, and such an impact causes the top rim to flex or bend (the degree of which depends on materials used). The flexing or bending causes a portion of the energy from the impact of the stick on the rim to be deflected and thereby not transmitted to the drums resonant chamber. This loss of energy due to deflection reduces the tonal quality of the drum and also allows for the drum tuning to degrade over even short periods of time.

When the lug screw lock of the present invention is installed on the drum lugs, lug screws, and/or shell, the drum rim becomes fixed in position. Once the drum is tuned and the lug screw locks are tightened into place the drum rim can no longer flex upon impact of the drum stick. When the component parts of the drum are solidly locked in their optimally tuned positions and no longer flex, they become a single solid piece of material. A solid material transmits sound energy more efficiently and with better tone than does a loose fitting assembly of parts that flex or move when struck. In summary, then, the present invention makes a drum behave like a solid one-piece instrument. It prevents reductions in drum head tensioning and prevents the upper hoop rim from flexing downward when struck. It provides for 99% of the percussive impact energy to be transmitted directly to the drum's resonant chamber, thereby providing the optimum tone and volume from the drums resonant chamber during each and every stick impact.

The added benefit of the present invention is significant. Tone counts for a great deal in music production. Great tone makes for great recordings, so the music industry and instrument manufacturers are looking for the best quality in instrument tone from artists. Recording professionals greatly prefer instruments that stay in tune and generate outstanding quality tone. Quality instruments save time and money, and ultimately they express and translate an artist's music with precision.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 6-6B are top plan, elevation side, and end views thereof; and

BEST MODE FOR CARRYING OUT THE INVENTION

Figure 1B:
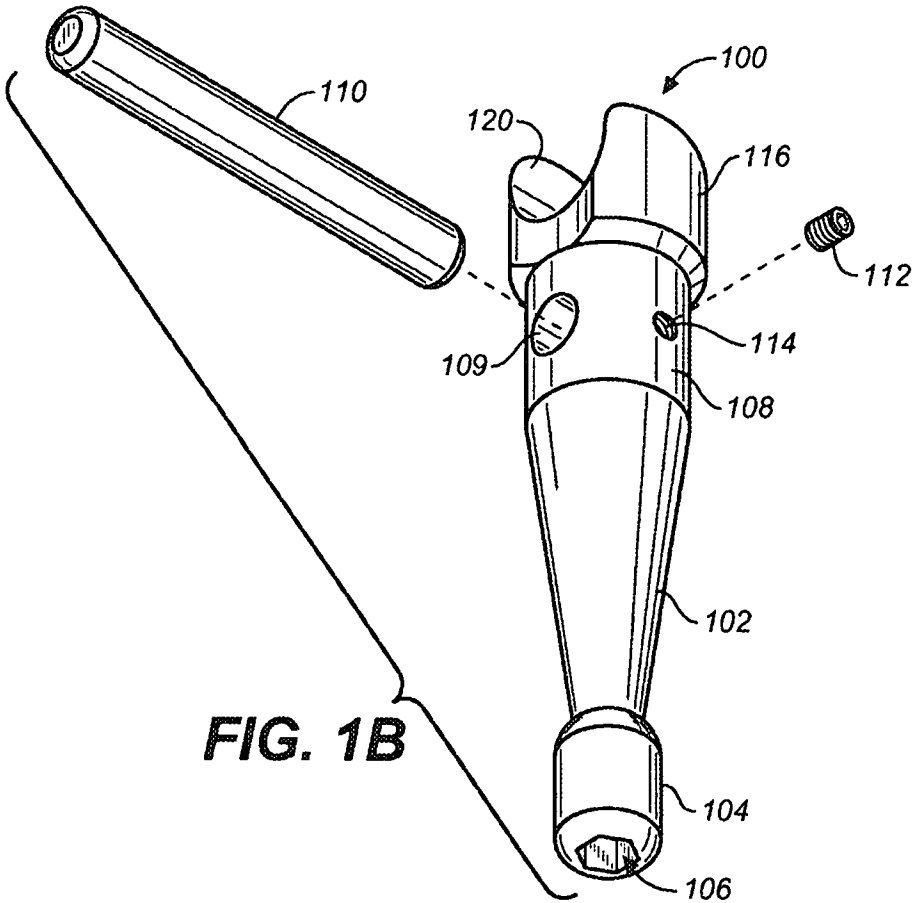
FIGS. 1A-2B are various views of a tuning key employed to engage and move the structural lug screw lock of the present invention.
Figure 1A:
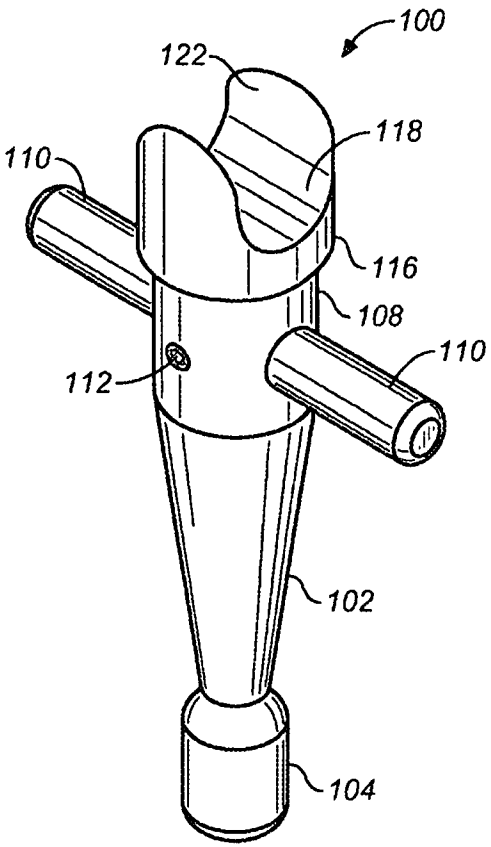
Figure 2B:
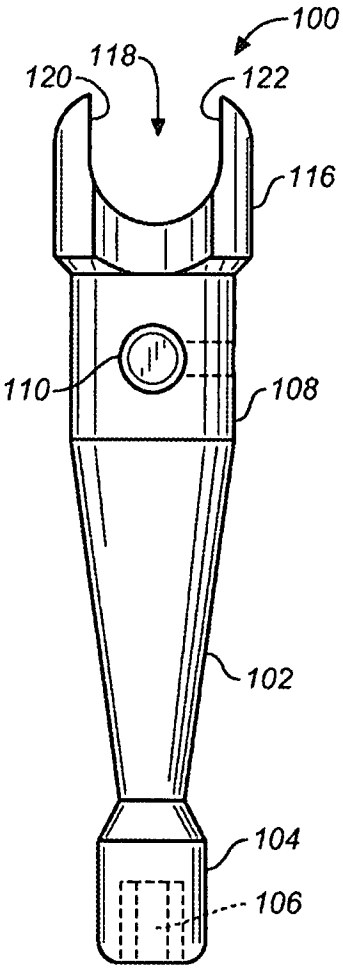
Figure 2A:
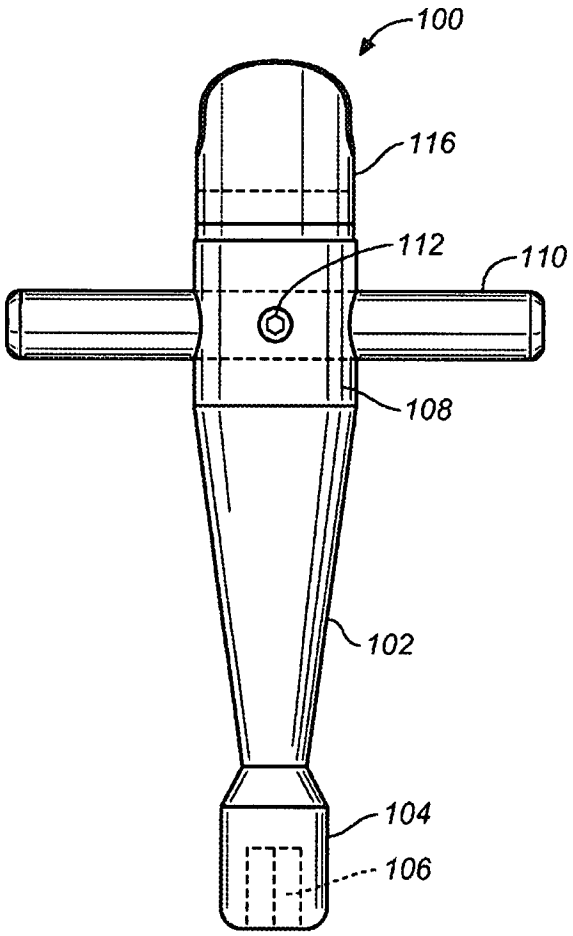

Referring first to FIG. 1 through FIG. 4B, wherein like reference numerals refer to like components in the various views, there is illustrated therein a new and improved drum tuning mechanism that prevents unwanted tune changes during performance. In its most essential aspect, the apparatus comprises a lug screw lock, generally denominated 10 herein, and a tool for adjusting the lug screw lock, the tool being generally denominated 100 herein.

Figure 3A:
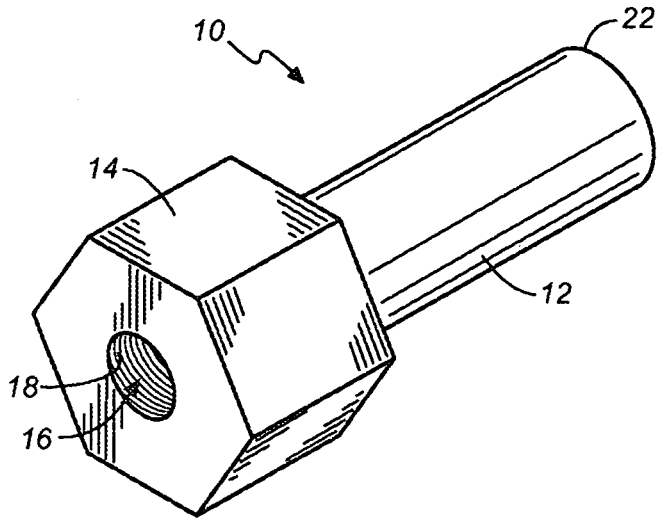
FIGS. 3A-3B are perspective and elevational side views of the lug screw lock of the present invention.
Figure 3B:
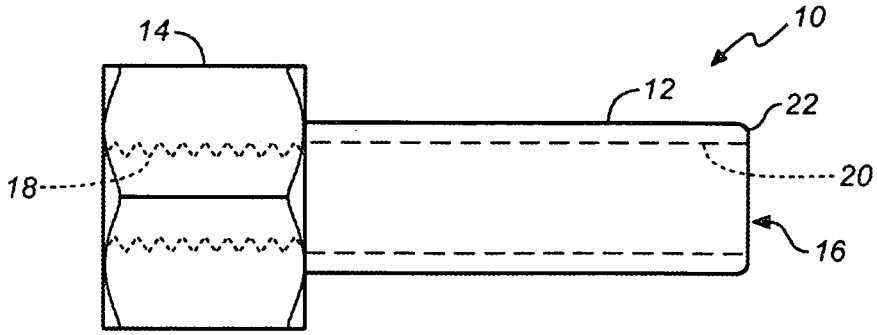

FIGS. 3A-3B show that the lug screw lock of the present invention comprises a shaft portion 12 and a head portion 14, preferably a hex head. An axially disposed through hole 16 runs the entire length of the lug screw lock, and includes a threaded interior portion 18 only in the head portion, whereas the shaft portion interior 20 is not threaded. As will be described more fully below, the end 22 of the shaft portion engages either the upper or lower hoop rim of a drum.

Figure 4:
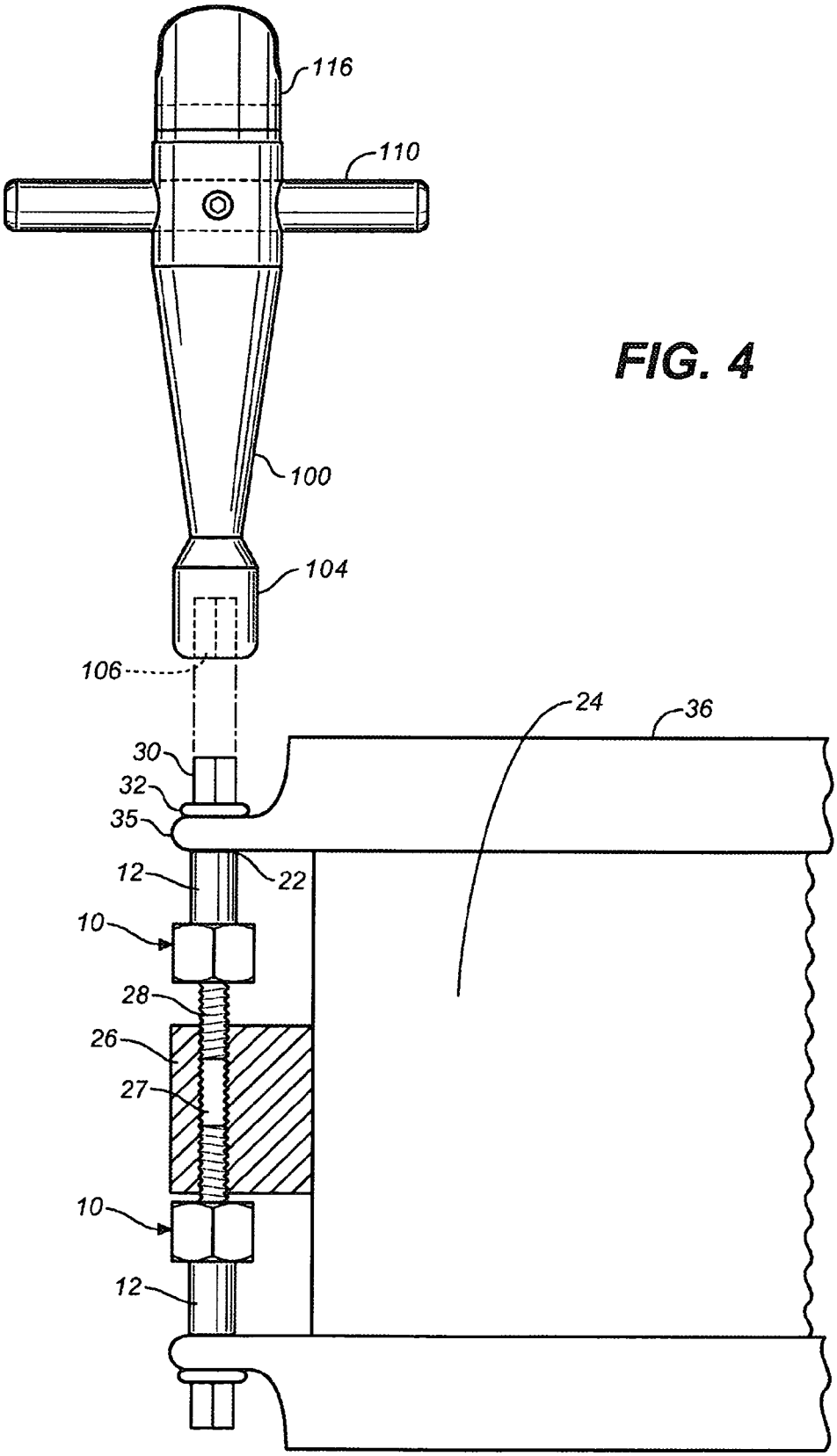
FIG. 4 is an elevational side view showing use of the tuning key and lug screw lock.
Figure 4A:
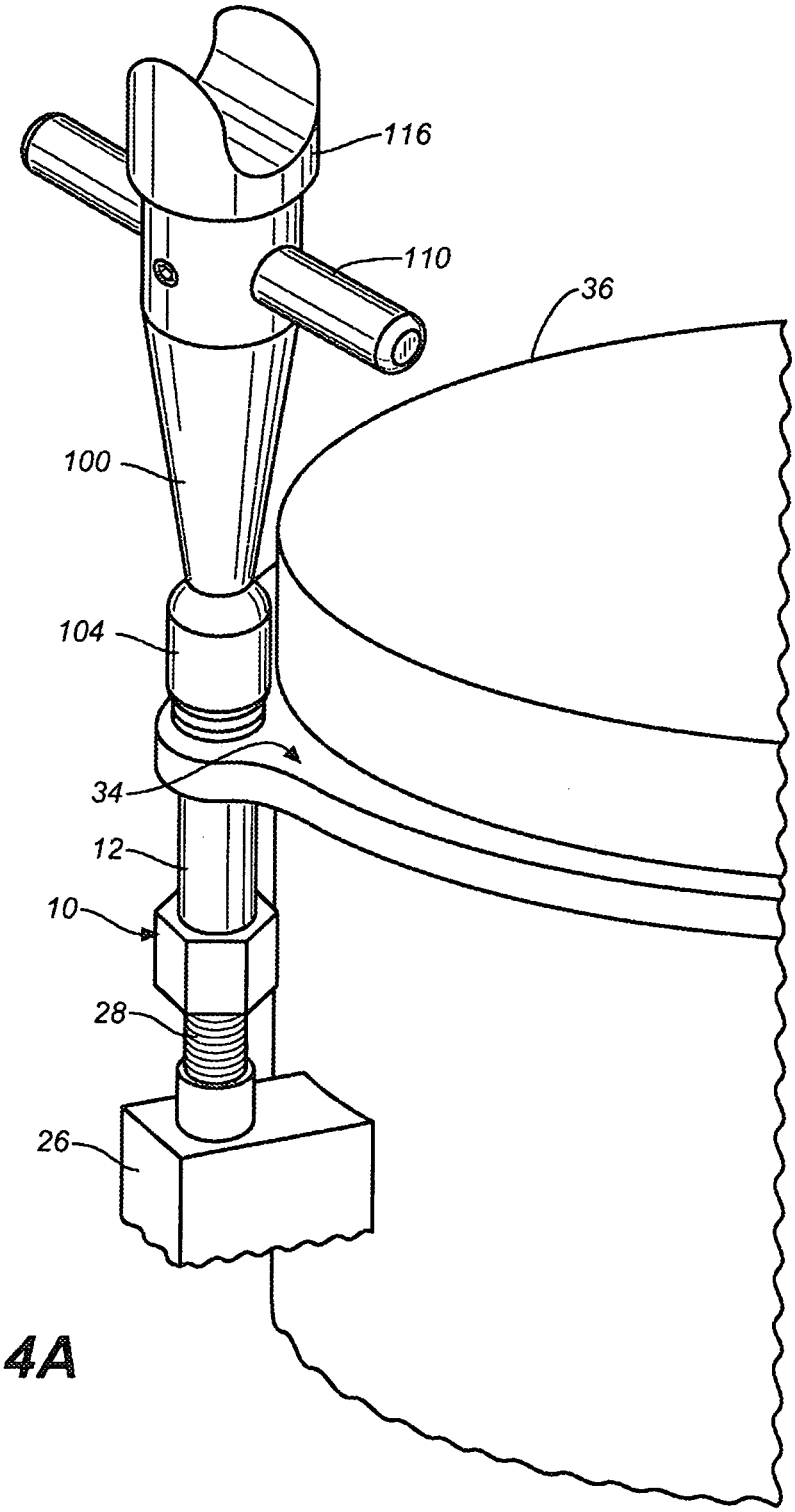
FIG. 4A-4B are upper perspective views thereof.
Figure 4B:
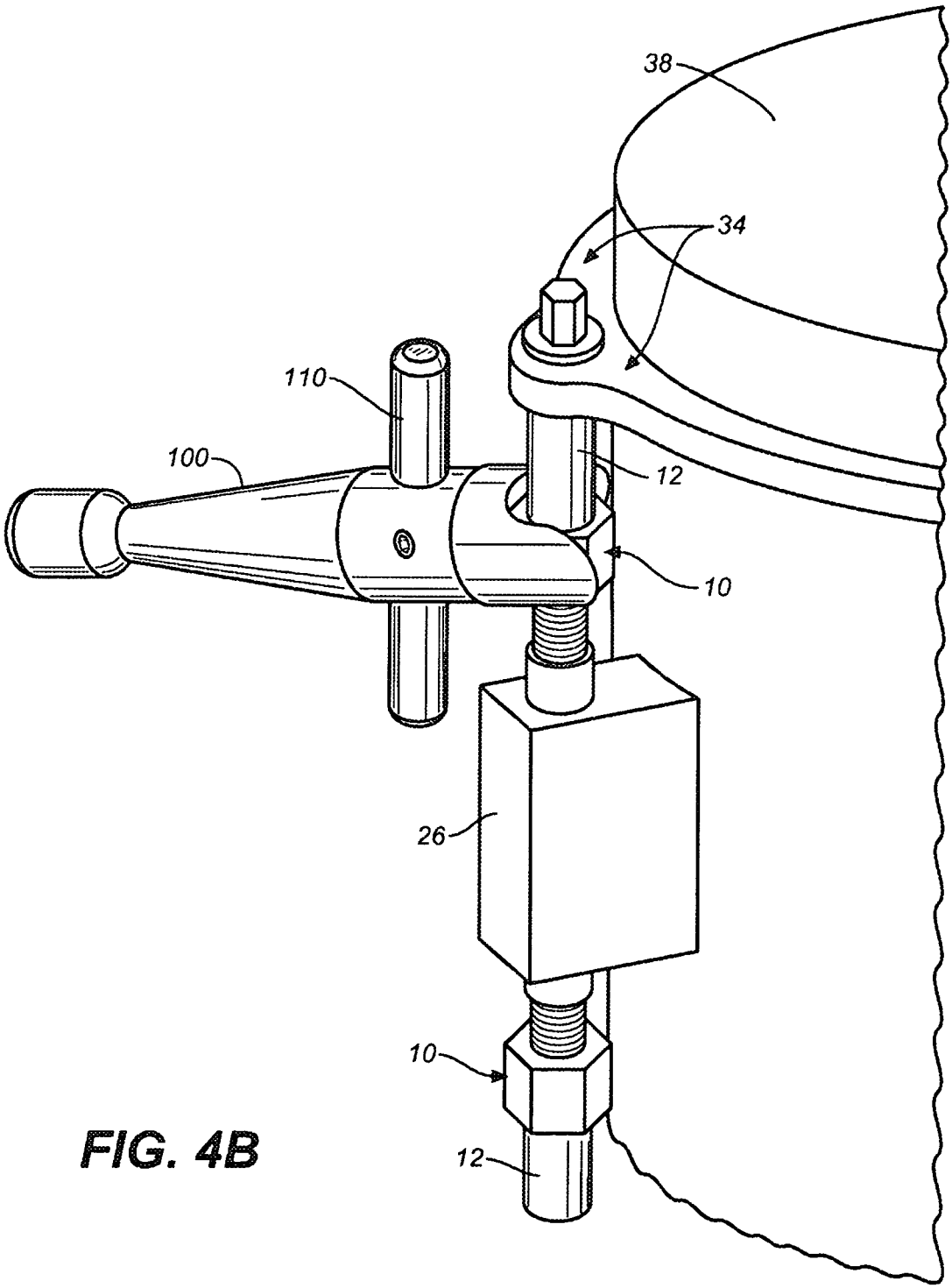
Figure 5A:
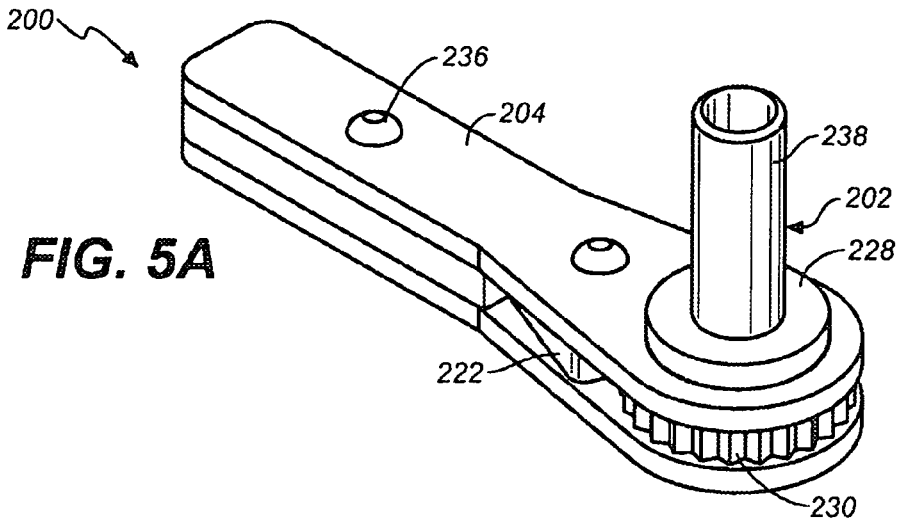
FIGS. 5A and 5B are upper perspective and exploded upper perspective views of second preferred embodiment of the lug screw lock of the present invention, showing a tuning tool incorporated into the inventive apparatus.
Figure 5B:
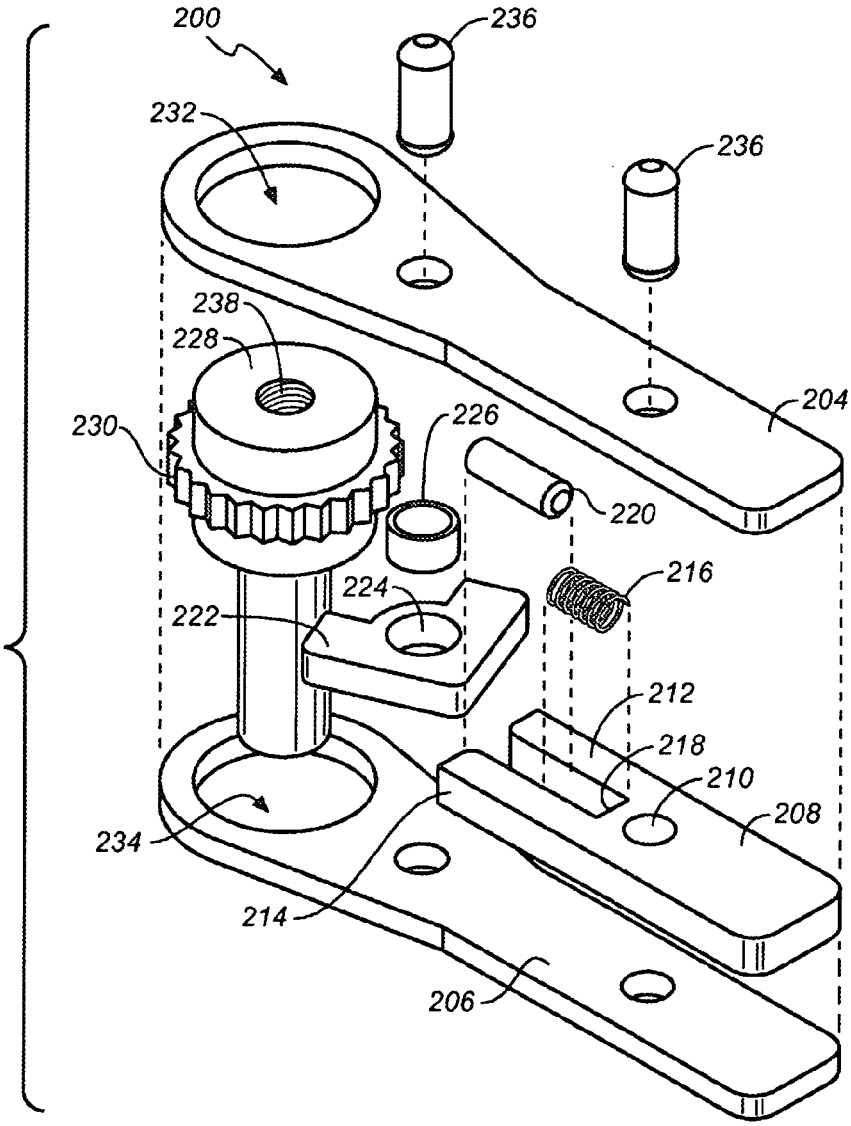

FIGS. 4-4B show how the inventive lug screw lock is installed on a conventional acoustic drum. The drum includes a drum shell 24 with a plurality of lug casings 26 circumferentially disposed around its exterior side. Each lug casing includes a threaded hole 27 for insertion of the threaded end of a lug screw 28 or tuning rod. The head 30 of the lug screw either engages a washer or includes an integral flange 32 that engages the upper surface 34 of the rim portion 35 of a drum hoop 36, such that tightening the lug screw in the lug casing urges the hoop rim down, thereby pulling the drum head material 38 tight across the opening of the resonant cavity of the drum.

As is seen in FIGS. 4-4B, the lug screw lock is installed in an inverted orientation when used to lock the lug screws engaging the upper hoop rim. In effecting an installation and tuning, the lug screw locks are threadably installed over the lug screws and disposed between the hoop rim and the lug casings. The lug screws are then tightened or loosened as required for optimal tone. The lug screw locks are then turned into a tight engagement with the underside of the hoop rim so as to pinch the rim between the lug screw head and the end 22 of the lug screw lock. This prevents the lug screw from loosening and unifies the drum components into improved tone transmitting elements.

Referring next to FIGS. 1A-2B, there is shown a first preferred embodiment of a tuning tool 100 employed to adjust the lug screw lock of the present invention. The tool is a substantially solid article that includes a tapered conical portion below which is a cylindrical tip 104 with a hex head wrench recess 106 sized to fit a lug screw head, as shown in FIG. 4A. Above the tapered conical portion is a substantially cylindrical medial portion 108 having a through hole 109 for insertion of a finger grip pin 110, which is pinned in place with a threaded set screw 112 threadably disposed in a threaded screw hole 114 oriented substantially normal the finger grip bar. Atop the cylindrical medial portion is a saddle 116 with a concavity 118 defined by spaced apart opposing vertical sides 120, 122 sized to tightly fit the outer sides of the lug screw lock hex head, as is shown in FIG. 4B.

Referring next to FIGS. 5A-7, there is shown a second preferred embodiment 200 of the lug screw lock of the present invention. In this version, the lug screw lock 202 is incorporated into a socket-wrench-type tool that remains essentially permanently installed on a drum lug screw (see FIG. 7) to facilitate rapid instrument tuning without the need of any separate tuning tools. The wrench portion includes upper and lower face plates 204, 206 spaced apart by a forked face plate spacer 208 having a center hole 210. Disposed between the fingers 212, 214 of the plate spacer is a helical compression spring 216 which sits in the crotch 218 of the fork. A latch pin 220 engages the outer end of the spring and is interposed between the spring and a rocking latch 222 having a center hole 224. A bushing 226 is inserted into the latch pin center hole.

The lug screw lock in this embodiment does not include a hex head that can be turned with a wrench. Rather, the hex head is replaced with a cylindrical expansion 228 having an integral ring of gear teeth 230 circumferentially disposed around the cylindrical expansion and that engage the rocking latch 222 in a well known manner. The ring is captured on both sides by circular openings 232, 234 on each face plate. In assembly, the elements are sandwiched and secured by rivets 236.

As in the first preferred embodiment, only the head portion (cylindrical expansion 228) is threaded and therefore threadably engaged with the threads on a lug screw. The shaft portion 238 is without threads and slides as the threaded portion is turned in relation to the lug screw threads. The mechanism of engaging the hoop rim is identical to that of the first preferred embodiment, described above.

Figure 7:
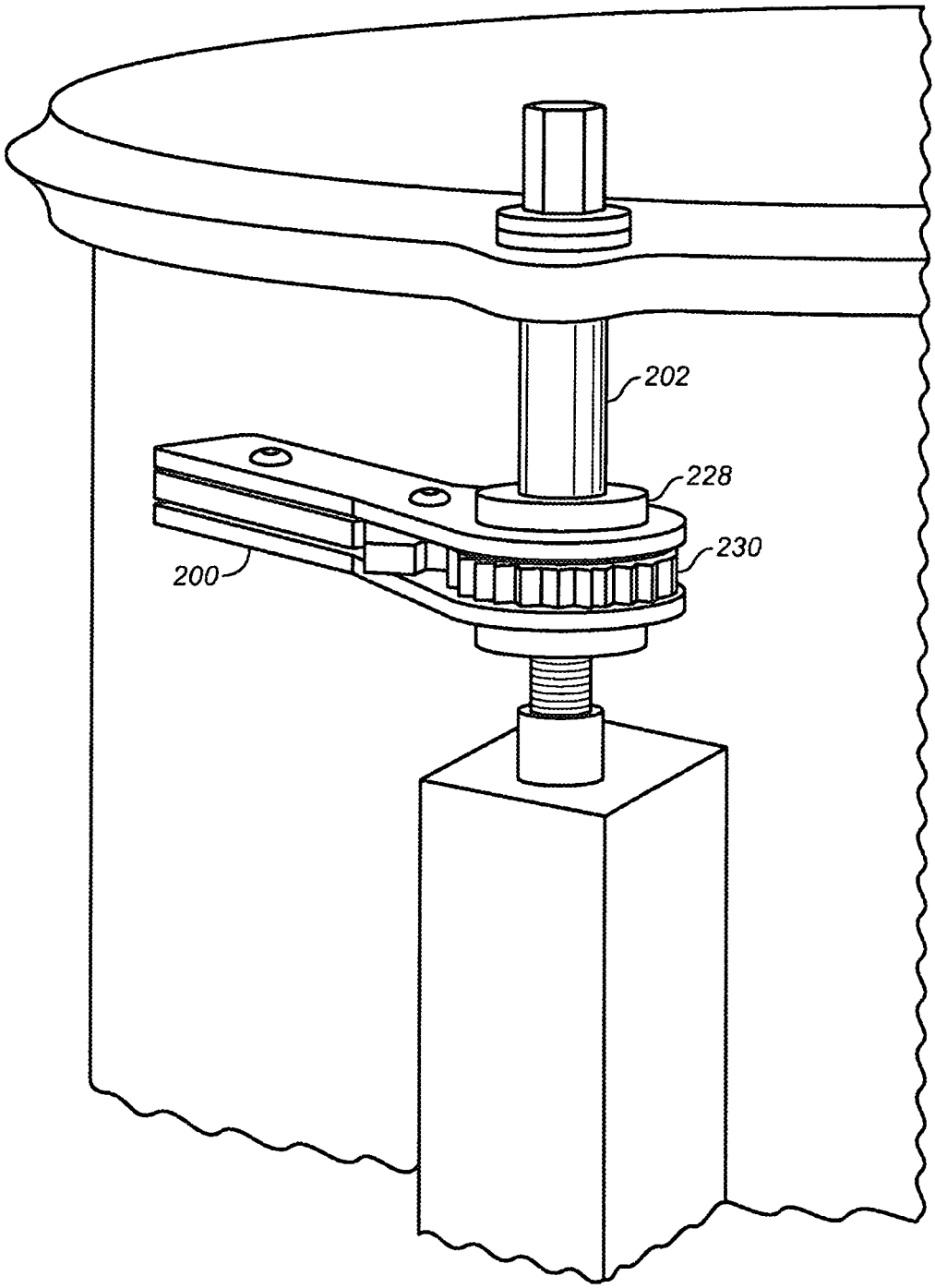
FIG. 7 shows the second preferred embodiment in use.

In use (see esp. FIG. 7), the ratcheting feature of the wrench allows a user to tighten or loosen the lug screw lock 202 by making the appropriate ratchet setting with the rocking latch and then turning the wrench in the appropriate direction. When the tuning procedure is complete, the latch can be leased and the handle secured proximate the drum shell so that it is out of the way.

From the foregoing, it will be appreciated that in its most essential aspect, the drum tuning stabilization mechanism of the present invention comprises a threaded lug screw shaft which can be rotated along its axis relative a drum shell to adjust the tension on a drum head material by changing the position of a drum hoop with respect to the drum shell, when the drum hoop is holding the drum head material in tension spanning a drum shell opening of the drum shell; wherein at least one of a lug casing of the drum shell and a rim portion of the drum hoop has a threaded hole therein configured to receive the threaded lug screw shaft for rotation; and further wherein a lug screw lock is threaded on the lug screw shaft adjacent the threaded hole of the at least one of the lug casing of the drum shell and the rim portion of the drum hoop and can be rotated to tighten the lug screw lock against a surface adjacent to the threaded hole of the at least one of the lug casing of the drum shell and the rim portion of the drum hoop to provide an interference fit to lock the threaded lug screw shaft to the surface adjacent the at least one of the lug casing of the drum shell and the rim portion of the drum hoop having the threaded hole therein.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A drum tuning stabilization mechanism comprising:

a threaded lug screw shaft which can be rotated along its axis relative a drum shell to adjust the tension on a drum head material by changing the position of a drum hoop with respect to said drum shell, when said drum hoop is holding said drum head material in tension spanning a drum shell opening of said drum shell;

wherein at least one of a lug casing of said drum shell and a rim portion of said drum hoop has a threaded hole therein configured to receive said threaded lug screw shaft for rotation;

wherein a lug screw lock is threaded on said lug screw shaft adjacent the threaded hole of said at least one of said lug casing of said drum shell and said rim portion of said drum hoop and can be rotated to tighten said lug screw lock against a surface adjacent to the threaded hole of said at least one of said lug casing of said drum shell and said rim portion of said drum hoop to provide an interference fit to lock said threaded lug screw shaft to the surface adjacent the at least one of said lug casing of said drum shell and said rim portion of said drum hoop having the threaded hole therein.

2. The drum tuning stabilization mechanism as in claim 1, wherein said threaded lug screw shaft has a head at one end.

3. The drum tuning stabilization mechanism as in claim 1, wherein said threaded lug screw shaft includes an enlarged diameter portion acting as an intermediate stop along said shaft preventing the portion of the shaft containing the enlarged diameter portion from slipping through a shaft sized hole in either said lug casing of said drum shell and said rim portion of said drum hoop having a hole therein in which said threaded lug screw shaft can freely rotate without axial motion.

4. The drum tuning stabilization mechanism as in claim 1, wherein said threaded lug screw shaft has a nut fixed thereto acting as an intermediate stop along said shaft preventing the portion of the shaft containing the enlarged diameter portion from slipping through a shaft sized hole in either said lug casing of said drum shell and said rim portion of said drum hoop having a hole therein in which said threaded lug screw shaft can freely rotate without axial motion.

5. The drum tuning stabilization mechanism as in claim 1, wherein both of said lug casing of said drum shell and said rim portion of said drum hoop have a threaded hole therein, wherein said threaded lug screw shaft has right handed threads at one end and left handed threads at a second thereof with complimentarily handed threads in the respective elements having threaded holes therein to receive the respective handed thread of the corresponding end of the threaded lug screw shaft.

6. The drum tuning stabilization mechanism as in claim 1, wherein said lug screw lock includes a hole there through having a threaded portion and an unthreaded portion along its axis.

7. The drum tuning stabilization mechanism as in claim 6, wherein an outside of said threaded portion of said lug screw lock is disposed with flats thereon having at least two sets of parallel opposing surfaces around its perimeter.

8. The drum tuning stabilization mechanism as in claim 6, wherein said threaded portion of said lug screw lock extends axially a dimension equal to or shorter than said unthreaded portion extends axially.

9. A drum tuning stabilization mechanism comprising:

a lug screw assembly having threadably interconnected portions wherein a first of the interconnected portions can be rotated relative to a second of interconnected portions to adjust the tension on a drum head material by changing the position of a drum hoop with respect to a drum shell, when said drum hoop is holding said drum head material in tension spanning a drum shell opening of said drum shell;

wherein a drum hoop head portion of said lug screw assembly is in contact with an upper surface of said drum hoop, wherein a lug screw locking portion of said lug screw assembly is in contact with a lower surface of said drum hoop, wherein when said drum hoop head portion of said lug screw assembly is adjacent an upper surface of said drum hoop and said lug screw locking portion of said lug screw assembly is adjacent a lower surface of said drum hoop and a locking shaft portion of said lug screw assembly is disposed through a hole in a rim portion of said drum hoop, a tightening rotation of said drum hoop head portion of said lug screw assembly relative to said drum hoop locking portion of said lug screw assembly creates a tension in said locking shaft portion of said lug screw assembly causing an interference fit locking of said drum hoop head portion, said lug screw locking portion, and said locking shaft portion of said lug screw assembly to said rim of said drum hoop.

10. A drum tuning stabilization mechanism comprising:

a drum shell having an opening covered by a drum head material, wherein an axis of said drum shell is perpendicular to an imaginary plane formed by said drum head material covering said opening to its perimeter, said drum head material held in tension across said opening by a drum hoop surrounding a portion of said drum shell, the tension in said drum head material being adjustable by rotating a tensioning element of a lug screw assembly, wherein a drum hoop end of said lug screw assembly engages an upper surface of said drum hoop and an opposite end of said lug screw assembly is fixed in a direction parallel to said drum shell axis, a lug screw locking element to engage said drum hoop to provide a force opposing a force created by tensioning said lug screw to pinch and secure the hoop and thereby prevent the drum head from loosening during drum play.

11. The drum tuning stabilization mechanism of claim 10 wherein said lug screw assembly includes a hole therethrough having internal threads.

12. The drum tuning stabilization mechanism of claim 11 wherein said hole therethrough has internal threads in a threaded portion thereof and no internal threads in a shaft portion thereof.

13. The drum tuning stabilization mechanism of claim 12 wherein said threaded portion includes a series of flats on an outer surface thereof for tightening with a wrench.

14. The drum tuning stabilization mechanism of claim 11, wherein lug screw assembly includes a series of flats on an outer surface thereof for tightening with a wrench.

15. The drum tuning stabilization mechanism of claim 11, wherein lug screw assembly includes a cylindrical expansion.

16. The drum tuning stabilization mechanism of claim 15, wherein said cylindrical expansion a series of integral gear teeth on an outer surface thereof.

17. The drum tuning stabilization mechanism of claim 15, wherein said series of integral gear teeth are engaged with a latch of an integral socket wrench type tool.

18. The drum tuning stabilization mechanism of claim 16, wherein said socket wrench type tool includes a top plate and a bottom plate with a pivoting latch engaging said integral gear teeth therebetween.

19. The drum tuning stabilization mechanism of claim 10, further comprising a hex wrench for tightening a head of said tensioning mechanism.

20. The drum tuning stabilization mechanism of claim 19, wherein said hex wrench includes a hex wrench recess.

21. The drum tuning stabilization mechanism of claim 19, wherein said hex wrench includes a concavity recess with vertical sides.

22. The drum tuning stabilization mechanism of claim 20, wherein said hex wrench includes a concavity recess with vertical sides.

23. The drum tuning stabilization mechanism of claim 20, wherein said hex wrench recess is disposed in a cylindrical tip of said wrench.

24. The drum tuning stabilization mechanism of claim 20, wherein said hex wrench includes a through hole.

25. The drum tuning stabilization mechanism of claim 24, wherein a finger tip pin is disposed in said through hole.

26. The drum tuning stabilization mechanism of claim 25, wherein a threaded set screw is disposed in a set screw hole and tightened to hold said finger tip pin in place.

27. The drum tuning stabilization mechanism of claim 10, wherein a second drum head covering is tensioned over a second opening of said drum shell opposite said first opening.

28. The drum tuning stabilization mechanism of claim 27, wherein second drum hoop is used to tension the second drum head covering.

29. The drum tuning stabilization mechanism of claim 28, wherein a second lug screw locking element engages said second drum hoop.

30. The drum tuning stabilization mechanism of claim 29, wherein a second lug screw locking element engages said second drum hoop to provide a second force opposing a force created by tensioning said second lug screw to pinch and secure the second hoop and thereby prevent the second drum head from loosening during drum play.

* * * * *